United States Patent [19]

Dickson

[11] Patent Number: 5,063,636

[45] Date of Patent: Nov. 12, 1991

[54] TRACK SYSTEM FOR OPERABLE WALL

[75] Inventor: Warren S. Dickson, Brea, Calif.

[73] Assignee: Advanced Equipment Corporation, Fullerton, Calif.

[21] Appl. No.: 579,409

[22] Filed: Sep. 7, 1990

[51] Int. Cl.[5] ..... E05D 15/06

[52] U.S. Cl. ..... 16/98; 16/106

[58] Field of Search ..... 16/98, 97, 95 R, 89, 16/87.4, 106, 107; 160/341, 344, 345; 104/93, 94, 95, 96, 89, 244

[56] References Cited

U.S. PATENT DOCUMENTS

| | | | |
|---|---|---|---|
| 3,253,552 | 5/1966 | Stein | 16/98 |
| 3,708,916 | 1/1973 | Karp, Jr. et al. | 16/97 |
| 3,843,995 | 10/1974 | Merrill | 16/97 |
| 3,879,799 | 4/1975 | Williams | 16/107 |
| 4,141,106 | 2/1979 | Dixon | 16/106 |
| 4,229,857 | 10/1980 | Toder | 16/95 R |
| 4,302,865 | 12/1981 | Dixon et al. | 16/97 |
| 4,752,987 | 6/1988 | Dreyer et al. | 16/106 |

*Primary Examiner*—Richard K. Seidel
*Assistant Examiner*—Chuck Y. Mah
*Attorney, Agent, or Firm*—Price, Gess & Ubell

[57] ABSTRACT

A track system for an operable wall includes carriage assemblies for partitions or operable wall sections including at least four wheels per assembly, the wheels being mounted on vertical shafts and having beveled lower surfaces for cooperating with beveled riding track surfaces integrally and conformably supported by support brackets.

20 Claims, 5 Drawing Sheets

TRACK SYSTEM FOR OPERABLE WALL

BACKGROUND OF THE INVENTION

1. Field of the Invention

The subject invention relates to movable partitions and, more particularly, to improved guiding apparatus for suspended partition walls, which permits the partition walls to be switched from one path of travel to another.

2. Description of Related Art

Prior art systems enabling switching or branching of movable partition walls from one track, guide, or path to another are known. Typically, branching is done from a first track to another track disposed at a right angle to the first one.

One such prior art system employs a single bolt with two horizontally rotating guide wheels rotatably mounted thereon, one above the other, as illustrated in U.S. Pat. No. 3,879,799. This prior art system could be improved in both operation and durability. With respect to operation, the prior art stacked wheel system requires that the stacked wheels change their direction of rotation at an intersection, which results in resistance to moving the associated partition at such intersections. With respect to durability, the stacked wheel approach of the '799 system puts an eccentric thrust load on a radial bearing, which the bearing is not designed to accommodate. In addition, the pendant bolt which mounts the wheels must be relatively long, increasing the likelihood of bending or breaking.

SUMMARY OF THE INVENTION

Accordingly, it is an object of the invention to improve guide systems for partition walls;

It is another object of the invention to provide such a guide system with improved durability;

It is another object of the invention to provide a guide system with improved operations at intersections of an overhead bearing system; and It is another object of the invention to eliminate binding attendant at intersections of some prior art systems and to facilitate smooth passage through such intersections.

These and other objects are achieved according to the invention by providing a guide track and roller assembly movable therein which cooperate with one another to provide a direction-switching capability. The guide track includes a bottom surface having a central linear groove with planar sides, each angled slightly downward toward the central groove. The roller assembly comprises a carriage which rotatably mounts four or more trolley wheels. Each trolley wheel is generally cylindrical in shape with a beveled bottom surface. The beveled bottom surface of each wheel cooperates with the angled bottom sides of the guide channel to facilitate movement and branching.

According to the invention, the load of operable walls is supported over four (4) or more wheels such that the pendant bolt can be shorter because all wheels are in the same plane, not stacked one over the other, reducing the likelihood of bending or breaking the pendant bolt. Load is applied to the bearing close to the center of the wheel, which will increase the life of the trolley assembly. Binding caused by a stacked approach is eliminated.

In addition, the trolley design reduces panel tilt, which makes operation easier when the panel is guided perpendicular to the track, as one would do when the panel is put into storage. The greater the angle the trolley tilts, the more scrubbing effect exists between the wheel and the track.

BRIEF DESCRIPTION OF THE DRAWINGS

The just-summarized invention will now be described in detail in conjunction with the drawings, of which.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a readily manufacturable improved operable wall system.

Figure 1:
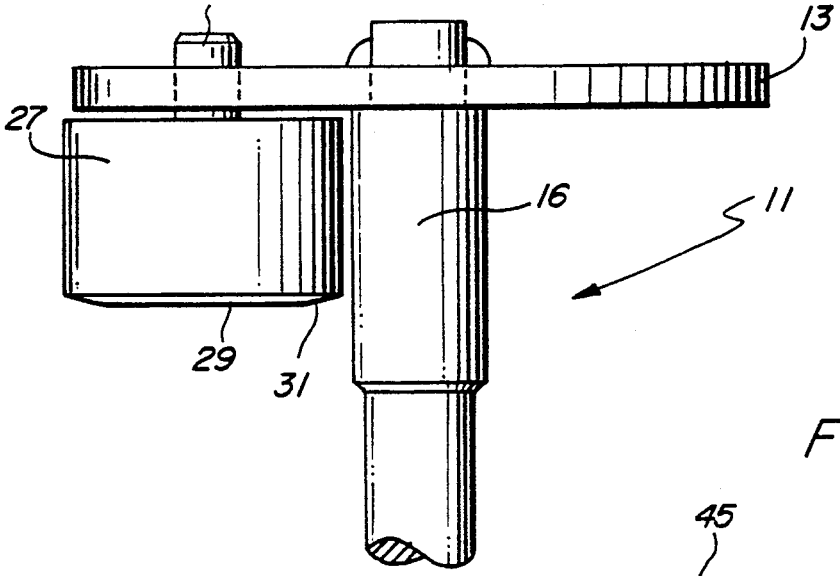
FIG. 1 is a side sectional view illustrating a wheel assembly according to the preferred embodiment.
Figure 2:
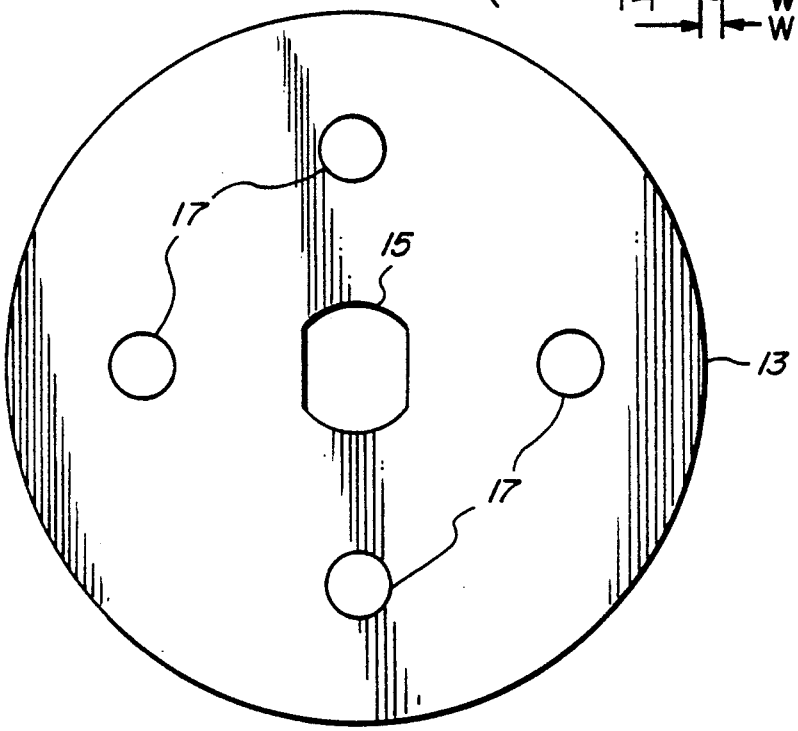
FIG. 2 is a top view of the assembly of FIG. 1.

FIGS. 1 and 2 illustrate the wheel carriage assembly or trolley 11 according to the preferred embodiment. The assembly 11 includes a flat circular carriage plate 13 having a central bore 15 therein and four holes 17 disposed radially, 90 degrees apart from one another about the central bore 15. The central bore 15 is shaped to accommodate the shaft of a pendant bolt 16 such as a ¾ NC "Double D" bolt in locking fashion therein. With a four-wheel trolley, the pendant bolt is fixed to the trolley by welding, a key, dowel, spline, or other similar means to prevent the trolley from rotating. If the trolley were allowed to rotate in a four-wheel embodiment, there would be a possibility of the trolley sticking with one wheel in each branch of a four-way branch such as the branch illustrated in FIG. 7. With more than four wheels, the pendant bolt is not fixed to the trolley and is allowed to rotate.

Each hole 17 receives a respective shaft 25 on which a respective one of four trolley wheels 27 is rotatably mounted using conventional needle thrust and radial bearings. The wheels 27 are mounted adjacent to one another, preferably with their top surfaces all lying in a common plane, thus avoiding the stacked configuration of certain prior art approaches. As shown in FIG. 1, the lower edge 29 of each wheel has a beveled conical surface 31 thereon.

Figure 3:
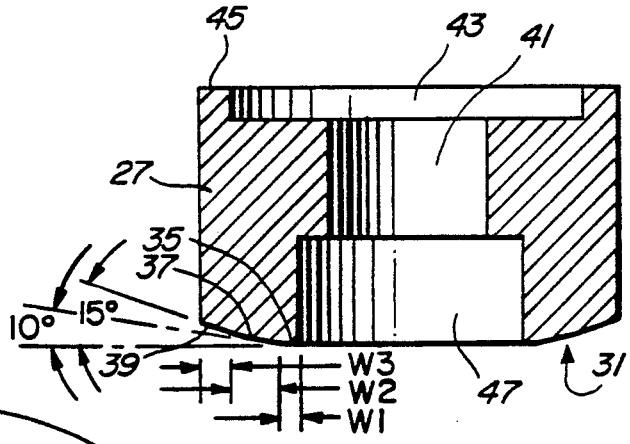
FIG. 3 is a cross-sectional view of a wheel according to the preferred embodiment.

FIG. 3 shows an embodiment of a wheel 27 in cross-section. The wheel 27 may be, for example, 1 inch high and 1.625 inches wide. In the embodiment in FIG. 9, the lower surface 31 of the wheel includes a first annular horizontal section 35, a second conical section 37 at a first angle, and a third conical section 39 at a second angle. The widths W1 of the first annular horizontal section W2 of the first conical section 37, and W3 of the second conical section 39 may be, for example: 1/16-inch, 3/16-inch, and ⅛-inch, respectively. The angles of the first conical section 37 and second conical section 39 may be, for example, 10 degrees and 15 degrees to the horizontal, respectively. The two-angle design facilitates a gradual approach to directional change at intersections and compensates for minor localized track surface deflections at intersection corners. Thus, the preferred embodiment provides smoother improved transition through branches of the guide track system.

As further shown in FIG. 3, the interior of the wheel 27 includes a central cylindrical cavity 41, which leads to a counterbore 43 in the top surface 45 of the wheel 27 and a counterbore 47 in the lower surface 31 of the wheel 27. The counterbores 43, 47 respectively provide a seat for a needle thrust bearing and clearance for a shoulder screw head.

Figure 4:
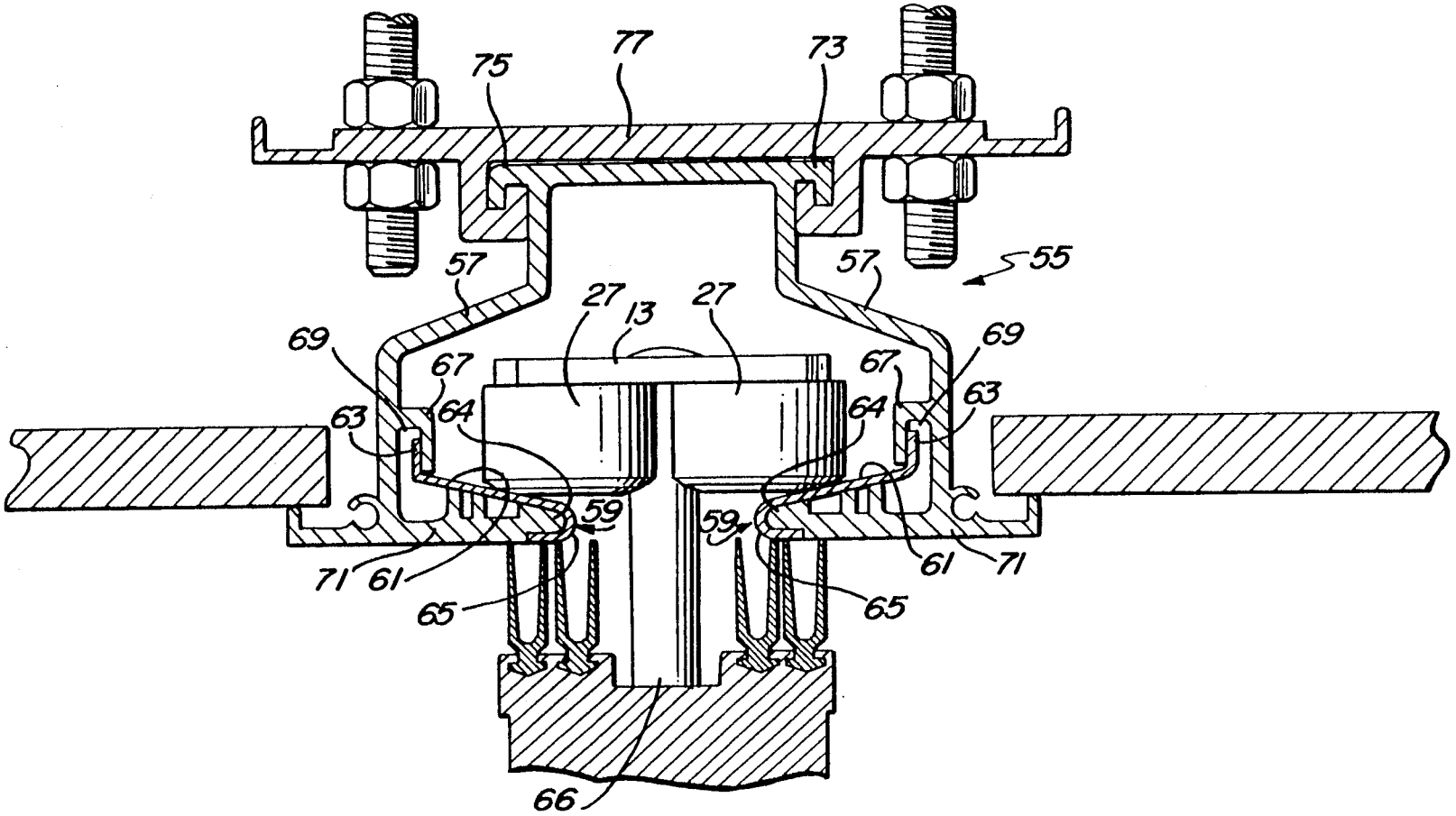
FIG. 4 is a cross-sectional view of a guide track and bracket assembly according to the preferred embodiment.

The carriage assembly just described rides in a guide track assembly 55, shown in FIG. 4. The track assembly 55 includes a mounting bracket 57, which suspends a guide track 59. As shown, the guide track 59 comprises a flat, angled riding surface 61, which turns upward at one end to form a vertical extension 63 and turns downward at the opposite end to form a U-shaped end portion 65. Riding surface 61 is at a slight angle, for example, 5 degrees, to the horizontal.

The bracket 57 includes a hooked portion 67 extending therefrom which forms a guide channel 69 to receive and retain the vertical extension 63 of the track 59. The bracket 57 further includes a horizontal end extension 71, shaped to support the riding surface 61 at the selected angle and to provide an end tab 64 which conforms to the inner surface of and mounts the U-shaped end 65. The bracket 57 may be formed from a sheet of metal or other material such as plastic, preferably extruded aluminum, as is the track 59. The track 59 is slidably inserted into the bracket 57 and then pinned in place. The bracket 57 also includes first and second upper hook portions 73, 75, which permit it to be suspended from a ceiling mounting bracket 77.

Figure 5:
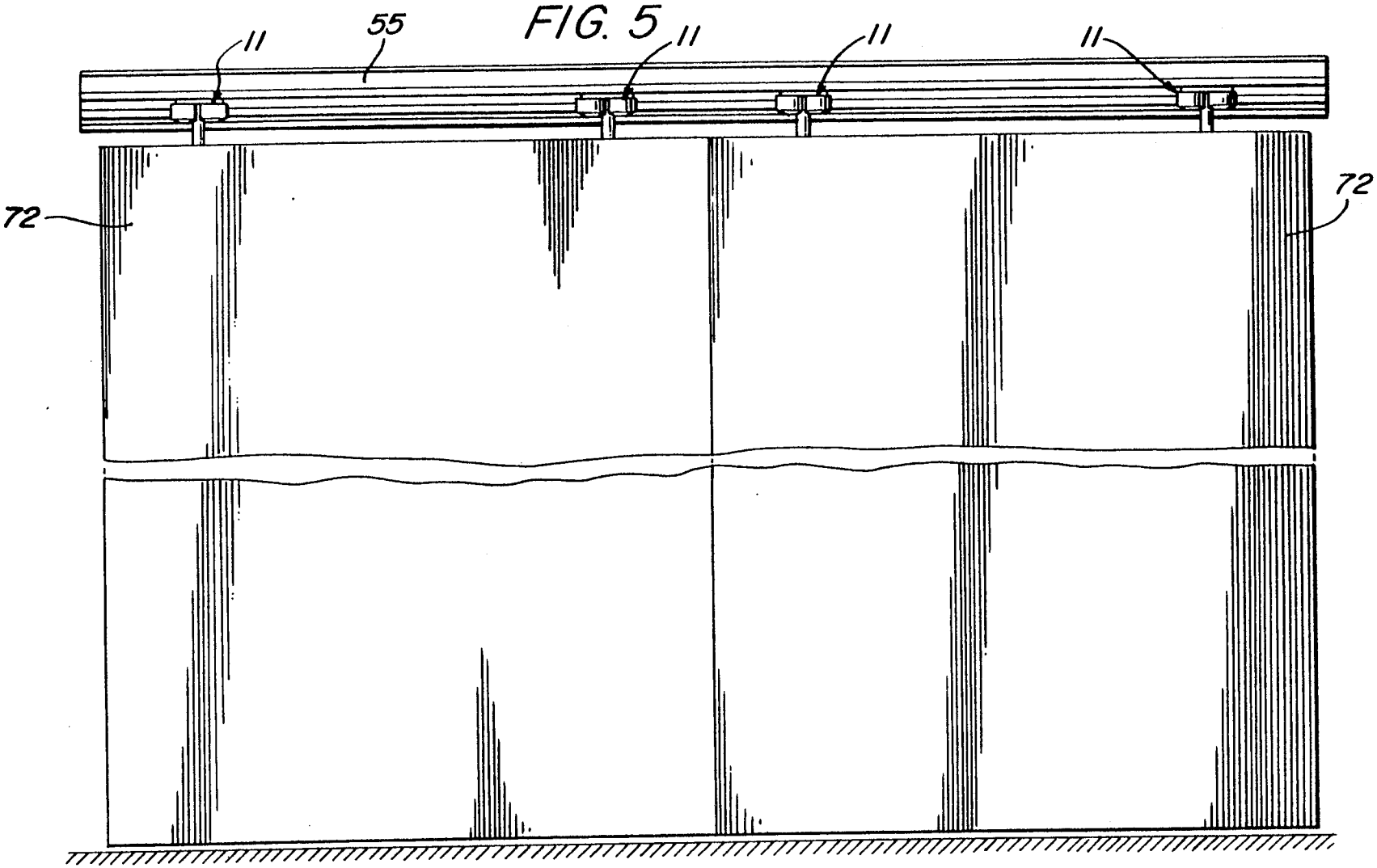
FIG. 5 is a side schematic view of operable wall sections suspended according to the preferred embodiment.
Figure 6:
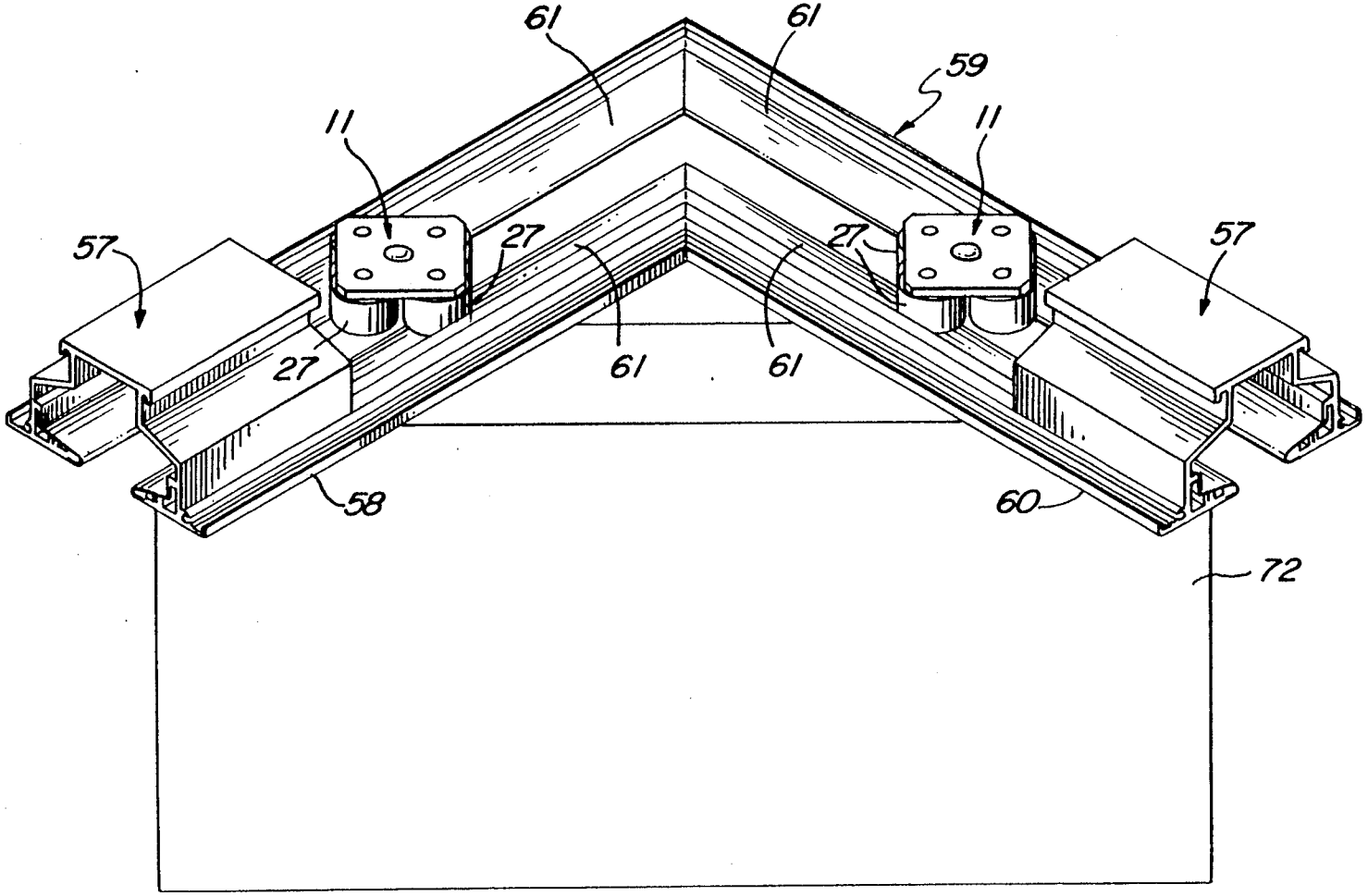
FIG. 6 is a perspective schematic view illustrating a right angle track and turn maneuver according to the preferred embodiment.

Various guide track configurations may be set up according to the preferred embodiment. FIG. 5 shows a linear section of a guide track assembly 55 and first and second operable wall sections 72 suspended therefrom by respective pairs of carriage assemblies 11. FIG. 6 shows a 90-degree or right angle section of guide track 59. First and second mounting brackets 57 are shown suspending the guide track 59. First and second carriage assemblies 11 suspend an operable wall or partition 72 from the guide track 59. In the position shown in FIG. 6, the operable wall 72 is at the halfway point in a turn or transition from alignment in parallel with one section 58 of the guide track 59 to alignment in parallel with the other section 60 of the guide track 59. In other words, the operable wall 72 is halfway through a 90-degree turn. When the carriage assembly 11 riding in guide track section 58 reaches the end of that section 58, the operable wall 72 will be positioned parallel to track 60. Carriage assembly 11 then rides on the pair of wheels 27 which are not riding on surfaces 61 in the position shown in FIG. 6.

Figure 8:
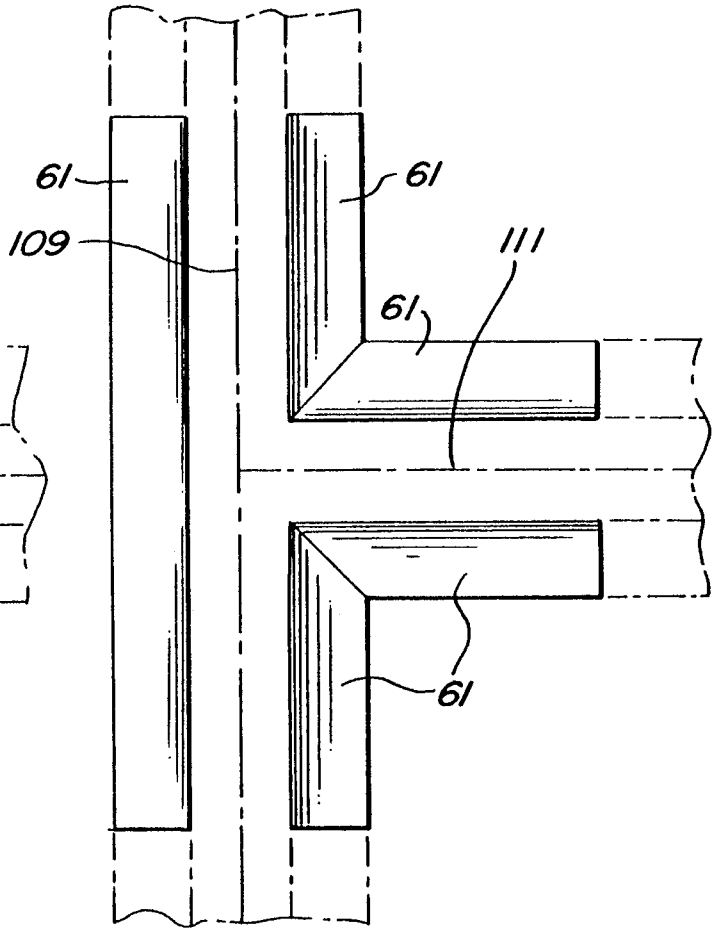
FIGS. 7 and 8 illustrate alternative guide track arrangements.
Figure 7:
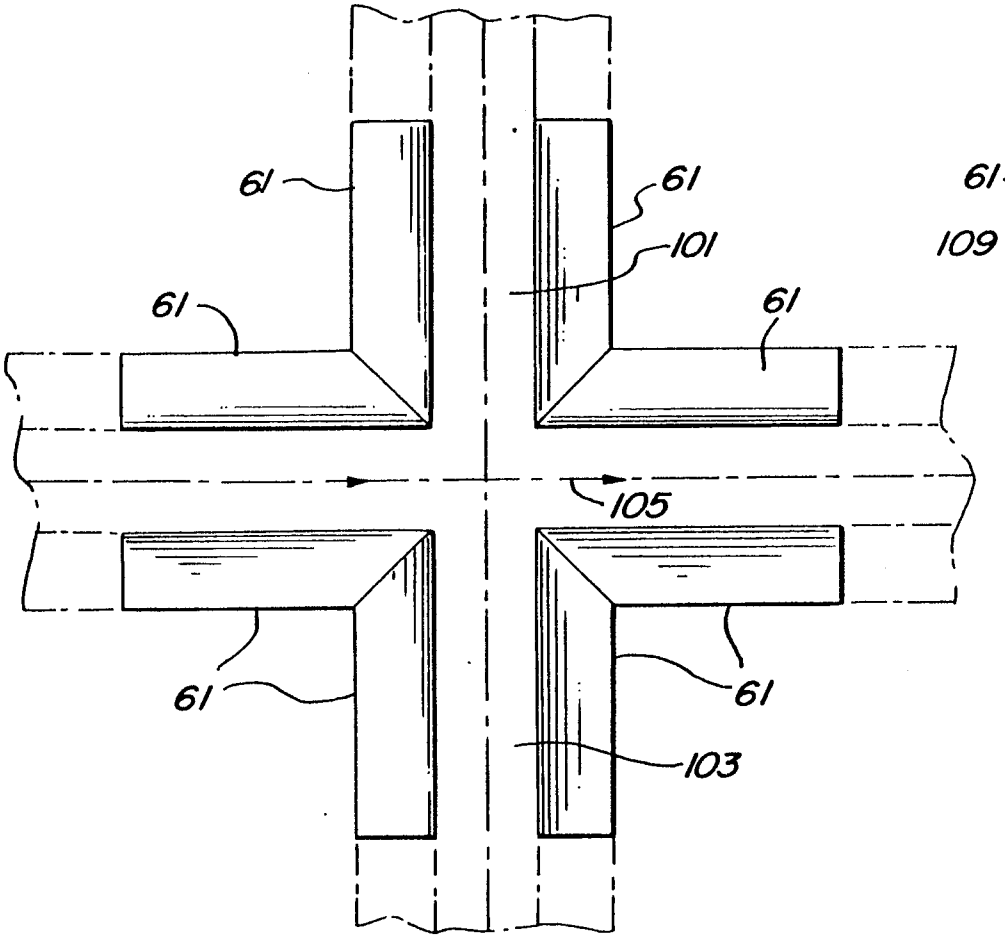

FIG. 7 illustrates the configuration of an alternative guide track wherein riding surfaces 61 are abutted in a fashion to permit 90-degree turns on two paths 101, 103 in opposite directions off the same straight line path 105. FIG. 8 illustrates an alternative "T" configuration permitting a carriage assembly to branch off a straight line path 109 onto a branch path 111 at a right angle thereto.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. An operable wall system for movably supporting an operable wall comprising:

a carriage assembly having at least four substantially horizontally rotating carriage wheels and at least four vertical shafts, said carriage wheels being horizontally spaced from one another and each carriage wheel being mounted on a respective vertical shaft and having a beveled bottom surface; and guide track means for providing first and second riding track surfaces for rollably supporting, at any given time, less than all though at least a pair of said carriage wheels, whereby said carriage assembly may smoothly negotiate a turn or transition in said guide track means, each of said first and second riding track surfaces being angled downward and defining a central groove therebetween.

2. The operable wall system of claim 1 further comprising a plurality of bracket means for suspending said guide track means.

3. The operable wall system of claim 2 wherein said guide track means further comprises:

a vertical extension at a first end of each said first and second riding track; and a U-shaped end portion at a second end of each said first and second riding track.

4. The operable wall system of claim 3 wherein said carriage assembly further comprises a flat carriage plate mounting said at least four vertical shafts, a pendent bolt extending through said central groove of said guide track means, and means in said carriage plate for mounting said pendent bolt.

5. The operable wall system of claim 4 wherein each carriage wheel includes means for mounting a needle thrust bearing therein.

6. The operable wall system of claim 3 wherein each said bracket means comprises:

first and second side walls;

a hooked interior portion on each of said first and second side walls receiving a respective said vertical extension; and means for supporting said first and second riding track surfaces.

7. The operable wall system of claim 6 wherein said means for supporting includes first and second end tabs conforming to the shape of and fitting into a respective U-shaped end portion of said first and second riding track.

8. The operable wall system of claim 3 wherein each carriage wheel lies substantially adjacent each other carriage wheel with the upper surface of each respective carriage wheel lying in a common plane.

9. The operable wall system of claim 1 wherein said riding track surfaces are each at an angle of about 5 degrees to the horizontal.

10. The operable wall system of claim 9 wherein each carriage wheel has a lower surface having a first conical section beveled at a first angle and a second conical section beveled at a second angle to the horizontal.

11. The operable wall system of claim 1 wherein each carriage wheel has a lower surface having a first conical section beveled at a first angle and a second conical section beveled at a second angle to the horizontal.

12. The operable wall system of claim 1 wherein the carriage assembly is fixedly mounted to the operable wall.

13. The operable wall system of claim 1 wherein the carriage assembly is rotatably mounted to the operable wall.

14. An operable wall system for movably supporting an operable wall comprising:

a carriage assembly fixedly mounted to an end of said operable wall and having at least four vertical shafts and four substantially horizontally rotating carriage wheels rotatably mounted to a respective vertical shaft, said carriage wheels being horizontally spaced from one another in substantially the same plane to form first and second opposed pairs of carriage wheels that are situated perpendicular to one another, each of said carriage wheels having a beveled bottom surface; and guide track means for providing first and second riding track surfaces for rollably supporting one though generally not both of said first and second opposed pairs of carriage wheels at any given time, whereby said carriage assembly may smoothly negotiate a turn or transition in said guide track means, each of said first and second riding track surfaces being angled downward to cooperate with said beveled bottom surface of each carriage wheel and defining a central groove therebetween.

15. The operable wall system of claim 14 wherein said guide track means further comprises:

a vertical extension at a first end of each said first and second riding track; and a U-shaped end portion at a second end of each said first and second riding track.

16. The operable wall system of claim 15 wherein said carriage assembly further comprises a flat carriage plate mounting said at least four vertical shafts, a pendent bolt extending through said central groove of said guide track means, and means in said carriage plate for mounting said pendent bolt.

17. The operable wall system of claim 16 wherein each carriage wheel includes means for mounting a needle thrust bearing therein.

18. The operable wall system of claim 16 further comprising a plurality of bracket means for suspending said guide track means, wherein each said bracket means comprises:

first and second side walls;

a hooked interior portion on each of said first and second side walls receiving a respective said vertical extension; and means for supporting said first and second riding track surfaces.

19. The operable wall system of claim 18 wherein said means for supporting includes first and second end tabs conforming to the shape of and fitting into a respective U-shaped end portion of said first and second riding track.

20. The operable wall system of claim 14 wherein each carriage wheel has a lower surface having a first conical section beveled at a first angle and a second conical section beveled at a second angle to the horizontal.

* * * * *